US007673359B2

(12) United States Patent
Lee

(10) Patent No.: US 7,673,359 B2
(45) Date of Patent: Mar. 9, 2010

(54) DRUM-TYPE WASHER CONTROL METHOD AND DRUM-TYPE WASHER USING THE SAME

(75) Inventor: Phal Jin Lee, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 1078 days.

(21) Appl. No.: 11/102,792

(22) Filed: Apr. 11, 2005

(65) Prior Publication Data

US 2006/0000243 A1 Jan. 5, 2006

(30) Foreign Application Priority Data

Jun. 30, 2004 (KR) ..... 10-2004-0050195

(51) Int. Cl.
*D06F 33/02* (2006.01)

(52) U.S. Cl. ..... 8/158
n

(58) Field of Classification Search ..... 8/158, 8/159; 68/12.06, 12.12, 12.14, 12.23, 23 R, 68/23.1, 24
See application file for complete search history.

(56) References Cited

U.S. PATENT DOCUMENTS 5,970,555 A * 10/1999 Baek et al. ..... 8/159
2003/0168084 A1* 9/2003 Jo et al. ..... 134/25.1

FOREIGN PATENT DOCUMENTS

DE 198 22 717 A1 11/1998
EP 1 568 813 A1 8/2005

* cited by examiner

*Primary Examiner*—Joseph L Perrin
(74) *Attorney, Agent, or Firm*—Birch, Stewart, Kolasch & Birch, LLP

(57) ABSTRACT

An apparatus and method control dewatering in a drum-type washer so that a dewatering cycle can be selectively modified by a user selection and so that noise and vibration on a dewatering cycle can be reduced. the apparatus includes a key input for selecting a wash course, the selected wash course corresponding to one of a plurality of selectable dewatering courses; memory for storing at least one eccentricity detection reference value per the selectable dewatering course; and a controller for performing the selected wash course based on the stored at least one eccentricity detection reference value. The method includes selecting a wash course, the selected wash course corresponding to one of a plurality of selectable dewatering courses; storing in memory at least one eccentricity detection reference value per the selectable dewatering course; and performing the selected wash course based on the stored at least one eccentricity detection reference value.

2 Claims, 4 Drawing Sheets

DRUM-TYPE WASHER CONTROL METHOD AND DRUM-TYPE WASHER USING THE SAME

This application claims the benefit of Korean Application No. 10-2004-0050195 filed on Jun. 30, 2004, which is hereby incorporated by reference.

BACKGROUND OF THE INVENTION

1. Field of the Invention

The present invention relates to a washer, and more particularly, to a method and apparatus for controlling a drum-type washer storing a set of eccentricity detection reference values that are selectable at the time of wash course selection to perform a dewatering cycle as desired.

2. Discussion of the Related Art

A drum-type washer uses the drive force of a motor to perform sequentially washing, rinsing, and dewatering cycles by rotating an inner tub with respect to an outer tub accommodating a load of laundry and water. The structure of a general drum-type washer is shown in FIG. 1.

Referring to FIG. 1, a drum-type washer comprises a tub 2 suspended within a body 1 by a damper 7 and a spring 6, a cylindrical drum 3 rotatably provided within the tub centering on a horizontal axis, and a drum motor 5 coupled with the drum via a drum shaft 4. The drum motor 5 is provided behind the tub 2 and includes a rotor 5*b* and a stator 5*a*. The drum shaft 4 is rotated together with the drum 3 and is directly connected to the rotor 5*b* to transfer directly a drive force of the rotor to the drum 3, which is provided with a plurality of lifters 3*a* installed axially on its inner surface. A door 8, opposing a forward opening of the drum 3, is provided to a predetermined portion of a front side of the body 1, and a gasket 9 for sealing the drum is provided between the door and drum. A control panel 10, disposed above the door 8, is provided to enter user commands for controlling washer operation.

In the above drum-type washer, a wash cycle is carried out when a rotational force of the rotor 5*b* is transferred to the drum 3 via the drum shaft 4, so that laundry within the rotating drum 3 is lifted by the lifters 3*a* and then falls by gravity. After completion of the wash cycle and a predetermined number of rinse cycles, a dewatering operation is performed by a high-speed rotation of the drum 3, which generates a centrifugal force while the water is drained from the tub 2. The rotational speed of the drum 3 depends on the drive of the drum motor 5, which is driven at a low rotational speed in a washing mode but is driven at a high rotational speed for dewatering.

Referring to FIG. 2, illustrating motor speed over time during a dewatering cycle as above, dewatering is performed according to a dewatering algorithm as a series of untangling steps followed by an intermittent dewatering stage including at least first and second intermittent dewatering periods with eccentricity detection being performed before and after each period to determine whether to accelerate the drum motor 5 for high-speed rotation for entering the main dewatering stage. In each untangling step, the rotational speed is approximately 70 rpm for a predetermined time to untangle the laundry, after which the first eccentricity detection is performed by holding the speed at about 108 rpm for a predetermined duration to steady the rotation. Thereafter, the first intermittent dewatering period of the intermittent dewatering stage is entered by accelerating to, say, 170 rpm, whereby partial dewatering and some amount of laundry settling occurs before decreasing the rotational speed back down to an eccentricity detection speed to perform another (i.e., the second) eccentricity detection. If the eccentricity detection determines that a state of unbalance is still present, a second intermittent dewatering period is entered by accelerating to a higher speed, say, to 300 rpm, whereby additional dewatering and laundry settling occurs before performing yet another (i.e., the third) eccentricity detection is performed. Assuming that the eccentricity detection shows an acceptable degree of balance in the rotating drum, such that high-speed rotation without excessive noise or vibration or undue loading can occur, an acceleration to as high as 600 rpm or more is achieved to perform the main dewatering under normal conditions, which may include further acceleration to 800 rpm before a predetermined dewatering time expires.

Eccentricity detection, which may be peculiar to an installation environment or operational habits, is performed by comparing a detected eccentricity with an eccentricity detection reference value stored in a lookup table and is referenced according to a detected laundry amount at the beginning of a selectable wash course. If the eccentricity detection reference value is too low, it may be difficult to enter the main dewatering stage. On the other hand, if the eccentricity detection reference value is too high, the ensuing levels of noise and vibration are likely to be excessive.

In the dewatering algorithm of the related art drum-type washer as described above, the lookup table storing the eccentricity detection reference value is set by the manufacturer of the drum-type washer. The eccentricity detection reference values of such a lookup table, however, may be unsuitable for a particular installation environment or the operational habits or preferences of a particular.

SUMMARY OF THE INVENTION

Accordingly, the present invention is directed to a drum-type washer control method and apparatus that substantially obviate one or more of the problems due to limitations and disadvantages of the related art.

An object of the present invention, which has been devised to solve the foregoing problem, lies in providing a drum-type washer, which enables a selectable dewatering course according to be performed by to a selected wash course.

It is another object of the present invention to provide a drum-type washer control method, by which noise and vibration levels on dewatering can be managed.

It is another object of the present invention to provide a drum-type washer control method, by which a plurality of selectable dewatering courses are provided.

It is another object of the present invention to provide a drum-type washer control method, by which eccentricity detection reference value can be selected by a user.

It is another object of the present invention to provide an apparatus suitable for performing any of the above methods.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drum-type washer, comprising means for selecting a wash course, the selected wash course corresponding to one of a plurality of selectable dewatering courses; memory for storing at least one eccentricity detection reference value per the selectable dewatering course; and a controller for performing the selected wash course based on the stored at least one eccentricity detection reference value.

In another aspect of the present invention, there is provided a method of controlling a drum-type washer. The method comprises selecting a wash course, the selected wash course corresponding to one of a plurality of selectable dewatering courses; storing in memory at least one eccentricity detection reference value per the selectable dewatering course; and performing the selected wash course based on the stored at least one eccentricity detection reference value.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
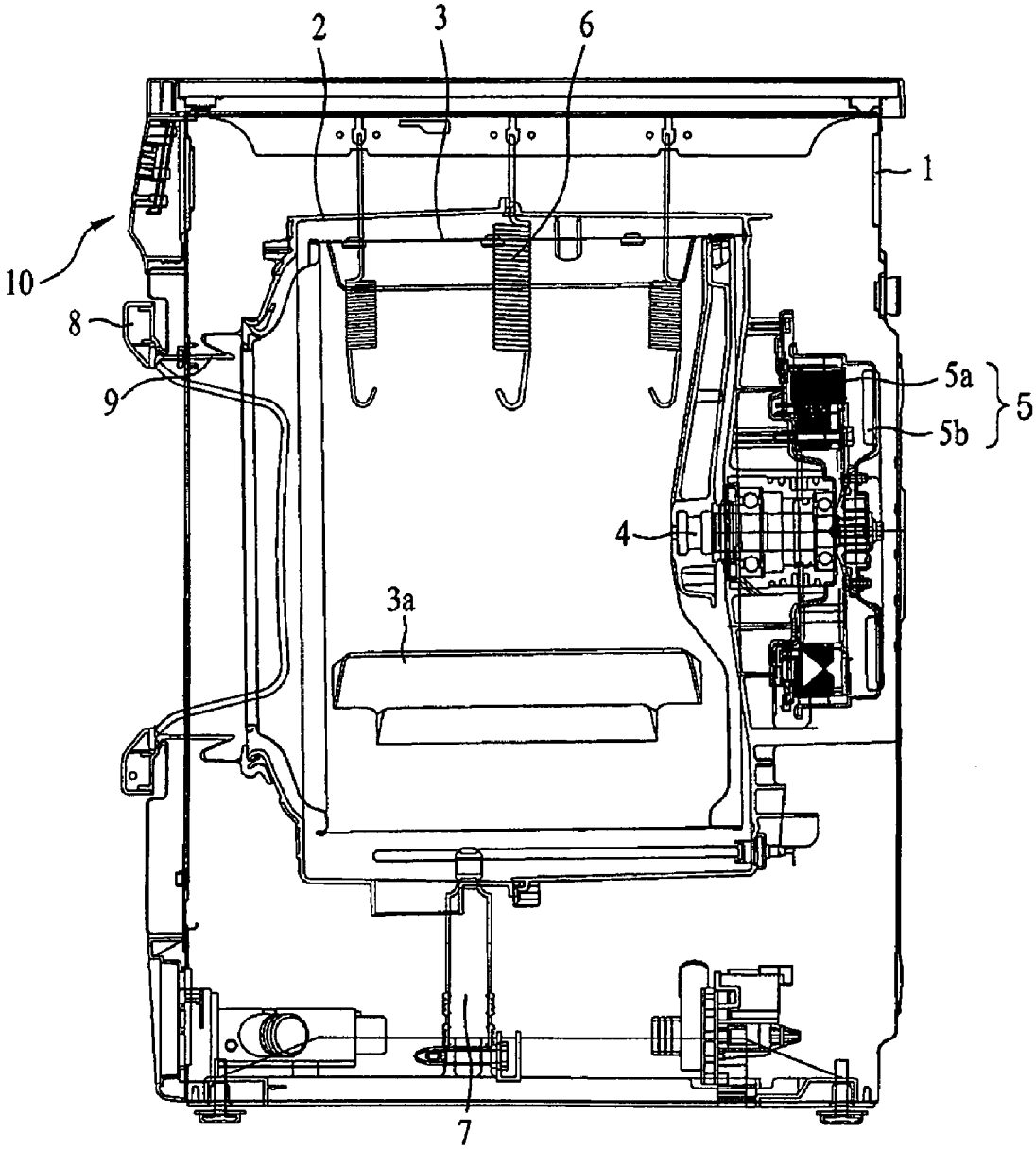
FIG. 1 Related Art
FIG. 1 is a cross-sectional diagram of a general drum-type washer.
Figure 2:
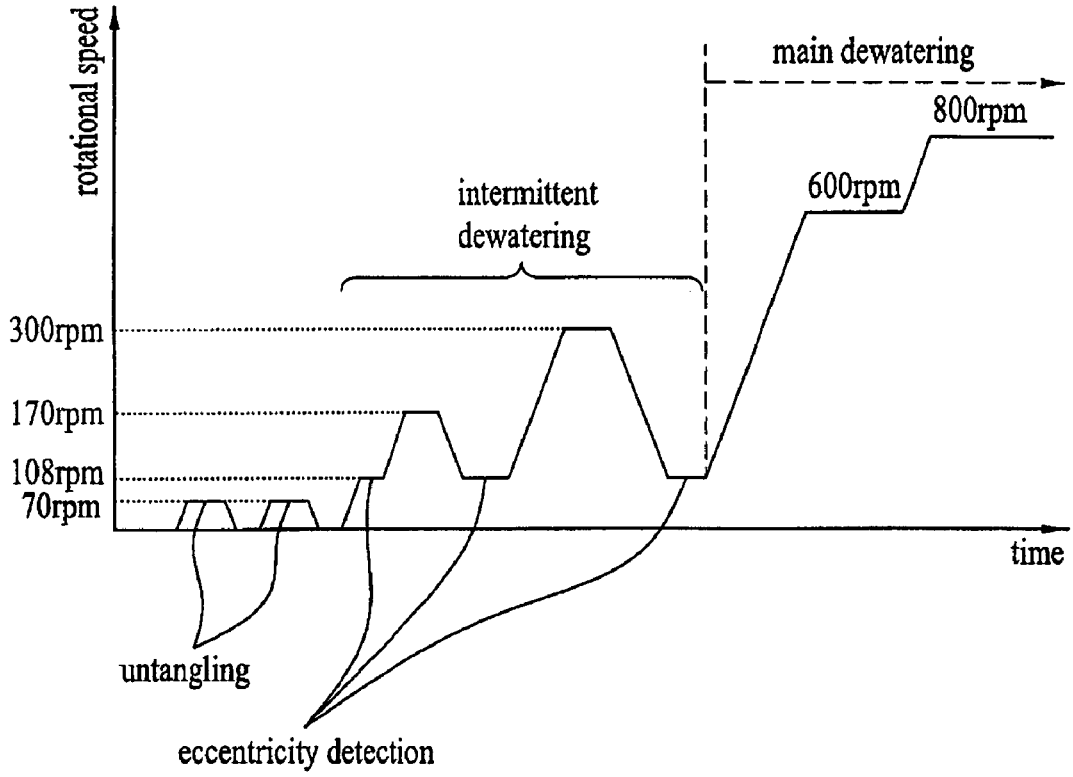
FIG. 2 Related Art
FIG. 2 is a graph illustrating a general dewatering cycle performed by a drum-type washer.
Figure 3:
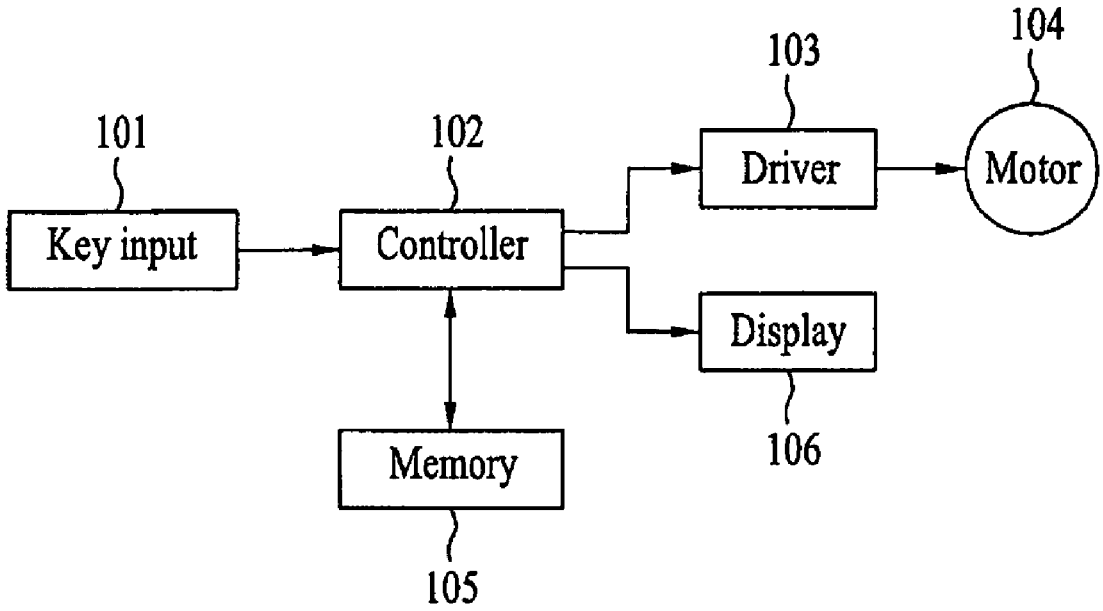
FIG. 3 is a block diagram of an apparatus for controlling a dewatering in a drum-type washer according to the present invention.

Referring to FIG. 3, a drum-type washer according to the present invention includes a key input 101 for selecting a user command and a specific wash course. The wash course includes a specific algorithm for performing the dewatering cycle according the specific wash course selected. The drum-type washer further includes a memory 105 for storing an eccentricity detection reference value per the specifically selected wash course and dewatering algorithm, and a controller 102 for performing a corresponding dewatering cycle based on at least one eccentricity detection using a corresponding eccentricity detection reference value and for outputting a control signal to a driver 103 for driving a drum motor 104. A display 106 may be provided for displaying an operational state and the like.

In the operation of the above-described apparatus, a user selects via the key input 101 a specific wash course and dewatering algorithm and then inputs an operation (e.g., start) command. The controller 102 then outputs a control signal to the driver 103 to enable the corresponding wash cycle according to the user-selected wash course, which includes wash and rinse cycles, while resetting the eccentricity detection values stored in the memory 105 according to the selected dewatering course and outputting the control signal to the driver to enable the corresponding dewatering course. That is, at the time of selecting the specific wash course, the user also makes a dewatering selection from a plurality of selectable dewatering courses, for example, a normal dewatering course or a silent dewatering course. In doing so, a corresponding set of eccentricity detection reference values for each successive period of the intermittent dewatering stage, which are stored in a lookup table of the memory 105 according to anticipated laundry amounts, are applied to the dewatering algorithm to be performed by the selected wash course.

| Normal dewatering course | |
|---|---|
| 1st eccentricity detection reference value | 40 |
| 2nd eccentricity detection reference value | 42 |
| 3rd eccentricity detection reference value | 42 |
| average level of noise | 65 dB |
| average degree of vibration | 80 μm |

| Silent dewatering course | |
|---|---|
| 1st eccentricity detection reference value | 30 |
| 2nd eccentricity detection reference value | 35 |
| 3rd eccentricity detection reference value | 35 |
| average level of noise | 67 dB |
| average degree of vibration | 60 μm |

In the above tables, it is assumed that all other laundry conditions are the same. Here, it should be noted that the eccentricity detection values of the silent dewatering course are lower than the corresponding values of the normal dewatering course. Though the noise level of the silent dewatering course may be higher than that of the normal dewatering course, the silent dewatering course results in considerably less vibration.

Figure 4:
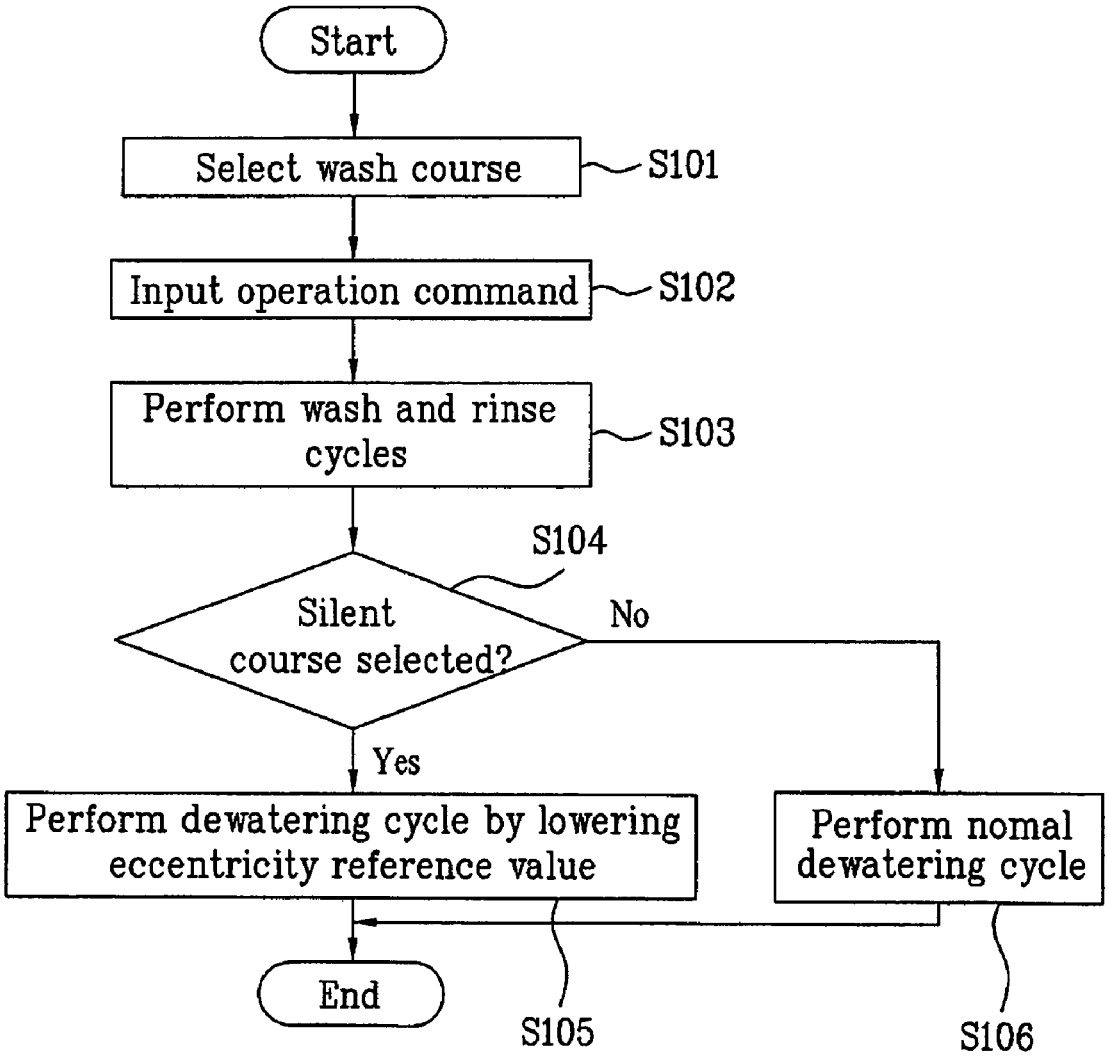
FIG. 4 is a flowchart of a method of controlling a dewatering in a drum-type washer according to the present invention.

Referring to FIG. 4, illustrating a method of controlling a dewatering in a drum-type washer according to the present invention, a user selects using the key input 101 a specific wash course and a specific dewatering course (S101) and then inputs an operation command (S102). According to the user input and the selected course, the controller 102 executes the selected wash cycle and rinse cycles (S103). Upon completion of the final rinse cycle, it is determined whether the silent dewatering course has been selected (S104). If the silent dewatering course is selected, the controller 102 performs (S105) the wash course, particularly including dewatering, by setting an eccentricity detection reference value accordingly, i.e., a low value, and otherwise carries out normal dewatering (S106). Here, it should be appreciated that the step S104 may be modified to consider a selection from any number of dewatering courses made available by the lookup table of the memory 105.

As described above, an optional dewatering course, e.g., a silent dewatering course, is selectable in addition to a normal dewatering course. If the silent dewatering course is selected, a lower eccentricity detection reference value is applied to a dewatering algorithm, control entry into the main dewatering stage and to manage noise and vibration levels. Thus, the user can arbitrarily select a specific dewatering course as desired.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A method of controlling a washer, comprising:

selecting a wash course, the selecting the wash course including selecting one of a plurality of selectable dewatering courses, wherein the selectable dewatering courses are set to include at least one of different eccentricity detection reference values, respectively;

storing in memory the at least one eccentricity detection reference value per the selected dewatering course; and performing the selected wash course and the selected dewatering course based on the stored at least one eccentricity detection reference value according to the selected dewatering course, wherein the stored at least one eccentricity detection reference is compared with a detected eccentricity to control the selected dewatering course, wherein the selectable dewatering courses include at least a normal dewatering course and a silent dewatering course, and wherein the at least one eccentricity detection reference value includes at least one normal dewatering eccentricity reference value corresponding to the normal dewatering course and at least one silent dewatering eccentricity reference value corresponding to the silent dewatering course, and the at least one silent dewatering eccentricity reference value is set lower than the at least one normal dewatering eccentricity reference value.

2. The method as claimed in claim 1, wherein, if the silent dewatering course is not selected by said selecting, the normal dewatering course is performed during said performing of the selected wash course.

* * * * *